United States Patent [19]

Keith

[11] Patent Number: 4,829,792

[45] Date of Patent: May 16, 1989

[54] DOUBLE DRUM BATCH WASHING MACHINE

[76] Inventor: M. Brent Keith, 3843 Henry Ct., N.W., Acworth, Ga. 30101

[21] Appl. No.: 77,889

[22] Filed: Jul. 27, 1987

[51] Int. Cl.[4] ..... D06F 31/00

[52] U.S. Cl. ..... 68/27; 68/58; 68/158

[58] Field of Search ..... 68/27, 58, 143, 148, 68/158, 171, 173, 139, 142; 134/65, 132, 119, 120, 163; 209/270; 51/164.1; 99/536

[56] References Cited

U.S. PATENT DOCUMENTS

| | | | |
|---|---|---|---|
| 10,796 | 4/1854 | Fairchild et al. | 134/119 X |
| 30,214 | 2/1980 | Bhavsar | 68/27 |
| 105,439 | 7/1870 | Deveau | 68/142 X |
| 2,300,690 | 11/1942 | Neuman | 68/158 X |
| 2,391,634 | 12/1945 | Lewis et al. | 134/163 |
| 2,851,829 | 9/1958 | Martin | 134/132 |
| 3,103,802 | 9/1963 | Streich | 68/148 |
| 3,336,768 | 8/1967 | Kleefisch | 68/58 |
| 3,608,338 | 9/1971 | Lutzen | 68/145 |
| 3,707,858 | 1/1973 | Gulzow et al. | 68/143 |
| 3,878,699 | 4/1975 | Steinort | 68/145 |
| 3,995,458 | 12/1976 | Grunewald et al. | 68/140 |
| 4,109,493 | 8/1978 | Hugenbruch | 68/27 |
| 4,156,358 | 5/1979 | Harrsch | 68/27 |
| 4,210,004 | 7/1980 | Stoll | 68/27 |
| 4,236,393 | 12/1980 | Katzfey | 68/27 |
| 4,485,509 | 12/1984 | Pellerin et al. | 8/158 |
| 4,494,265 | 1/1985 | Schmidt et al. | 8/159 |
| 4,499,621 | 2/1985 | Gasser | 8/158 |
| 4,674,691 | 6/1987 | Didion | 51/164.1 X |

FOREIGN PATENT DOCUMENTS

| | | | |
|---|---|---|---|
| 460561 | 12/1950 | Italy | 51/164.1 |
| 2055903 | 3/1981 | United Kingdom | 68/148 |

OTHER PUBLICATIONS

The Passsat Voss Mono-Shell Continuous Batch Washing System by Passat (1983).

Washex by Washex Machinery Corporation (8/83).

Continuous Batch Washing Systems: Industrial Wash Formula Applications by Graham N. Brown (The Passat Corporation).

The Passat Poensgen Continuous Batch Modular Washing System Setting the Criteria for Excellence in Double Drum Performance by Passat (The Passat Corporation) 1983.

Washing Equipment P18/P19 by Senkingwerk GmbH.

*Primary Examiner*—Philip R. Coe

*Attorney, Agent, or Firm*—Thomas & Kennedy

[57] ABSTRACT

A double drum batch washing machine comprises an inner cylinder, an outer cylinder, an inner helical transfer screw with the inner cylinder and an outer helical transfer screw within the space between the inner and outer cylinders. The inner helical transfer screw has a pitch in one direction and the outer helical transfer screw has a pitch in the other direction so that the compartments formed by the transfer screws within the inner cylinder and the space between the inner and outer cylinders define areas of overlap on the surface of the inner cylinder. The areas of overlap have holes formed therein so that fluid interchange is established between each outer compartment and only the corresponding overlapping inner compartment. Laundry is placed in the inner compartments and wash water is placed in the outer compartments such that it communicates with the inner compartments and the laundry contained therein. Laundry is washed by oscillating the washing machine through a predetermined angular arc. When the washing machine is rotated through a complete circle, laundry is transferred in one direction by the inner helical transfer screw and wash water is transferred in the opposite direction by the outer transfer screw.

10 Claims, 3 Drawing Sheets

DOUBLE DRUM BATCH WASHING MACHINE

BACKGROUND OF THE INVENTION

1. Field of the Invention

The present invention relates to laundry washing machines and more particularly to industrial washing machines.

2. Description of the Prior Art Industrial laundry washing machines having multiple washing compartments have been available for some time. Many of these machines comprise a horizontally mounted generally cylindrical chamber having a conveyor worm or auger screw rigidly mounted in the interior of the chamber so that several washing compartments are defined between the surfaces of the auger screw. Laundry to be washed in these machines is typically placed in the first compartment on one end of the machine and wash water containing proper detergents or other treating chemicals is introduced into the compartments. Introduction of wash water is typically achieved either by spraying it into the compartment from performations formed in the hub of the auger screw or by continuously supplying wash water from one end of the chamber and allowing it to flow through performations formed in the transfer screw walls and out the opposite end of the chamber.

With laundry and wash water in the compartment, the machine will generally be oscillated through a predetermined angular range several times which agitates the laundry in the wash water. At the end of this oscillation period, the machine will be rotated through a 360° arc which transfers the laundry to the next compartment in the chamber where it is again oscillated with wash or rinse water. This process is repeated until the laundry reaches the last compartment where it is removed from the machine.

Washing machines of the type described above are known in the laundry industry as mono-shell or single drum machines, examples of which are illustrated and disclosed in U.S. Pat. Nos. of Stoll et al (4,210,004) and Schmidt et al (4,494,265).

Another prior art washing machine design known as a double drum machine comprises several individual cylindrical inner washing drums connected together in series with passageways along their longitudinal axes. These inner drums are rotatable within fixed outer drums which contain wash water or other chemicals. Laundry to be washed is transferred to each inner drum in turn where wash water or other treating chemicals within the fixed outer drum enter through holes in the inner drum. The drum is then oscillated or rotated within the fixed outer drum to affect washing. At the end of each wash cycle, the laundry is transferred through the passageway to the next inner drum for the next wash cycle. This process is repeated for each washing drum until the laundry is clean. This type of machine is disclosed in U.S. Pat. Nos. to Pellerin et al (4,485,509), Harrsch (4,156,358), Hugenbrunch (4,109,493) and Bhaysar (Re. 30,214).

The prior art washing machines exhibit several shortcomings in operation. In the continuous flow wash water machines, water intermixes between chambers so that batches of cloths of different colors cannot be washed in the machine at the same time. In addition, large volumes of water are required to maintain the flow of the wash water through the machine and complicated valve and pipe systems are required to introduce detergent and other treating liquids into the wash water flow.

Machines with nonperforated auger screw walls in which wash water and other treatments are introduced into each chamber through a pipe extending along the axis of the screw also require complicated drain systems to remove the water from each compartment at the end of each wash cycle so that it will not be transferred with the cloths to the next washing compartment. In these as well as other prior art designs, dirt and heavy soil material washed from the laundry is often transferred with the laundry to the next compartment because it is too large to drain through the drain system with the water.

Prior art machines comprising series of individual inner washing drums rotatable within fixed outer drums tend to be even more complicated than continuous flow machines. Because of the individual compartments, complicated means of delivering wash water to each drum and draining it therefrom at the end of a wash cycle is required. These machines use a large quantity of water and often have a plurality of valves and flow pipes to clog.

SUMMARY OF THE INVENTION

The present invention is an improved apparatus and method for treating industrial laundry that overcomes the disadvantages of prior art washing machines. It comprises an outer generally cylindrical chamber and a generally cylindrical inner chamber inside the outer chamber and spaced therefrom. The space between the inner and outer chambers contains a generally helical transfer screw or auger screw that divides the space into several compartments for containing wash water and transferring it from one end of the machine to the other upon rotation of the machine. The inner chamber also contains a generally helical transfer screw rigidly attached along its outer periphery to the inside of the inner chamber and dividing the inner chamber into several compartments for containing laundry and transferring laundry from one end of the machine to the other upon rotation of the machine. The inner transfer screw has a pitch angle that is substantially the same as the pitch angle of the outer screw but in the opposite direction so that as the washing machine is rotated, wash water or other treating material is transferred by the outer screw in one direction while the laundry or other textile to be treated is transferred in the other direction by the inner screw.

The compartments formed in the space between the outer and inner chambers by the outer screw define areas of overlap on the periphery of the inner chamber with the compartments formed on the inside of the inner chamber. These areas of overlap on the inner chamber have perforations formed therein so that wash water in one of the outer compartments can flow only into the corresponding overlapping inner compartment and mix with the laundry therein. Thus the wash water does not intermix between wash compartments during washing. As the machine rotates during a transfer cycle, the wash water contained in only the last outer compartment is dumped out of the machine by the outside conveyor helix. Some water is also transferred out of the machine with the wet laundry. Only this amount of water expelled at one end by the outer helix plus the small amount that remains in the clothes need be added to the machine each cycle to maintain a full was water level. No complicated wash water inlet and drain system is required. Wash water is simply supplied to the first outside compartment on one end of the machine and it is conveyed to succeeding compartments by the outside helix upon each transfer rotation of the machine and finally out of the machine on the opposite end. In addition, dirt and other material from heavy soils in the laundry falls through the performations in the inner chamber to the corresponding outer chamber where it is transferred out of the machine with the wash water rather than being transferred with the laundry.

Other objects, features and advantages of the present invention will become apparent upon reading the following specification, when taken in conjunction with the accompanying drawings.

DETAILED DESCRIPTION

Figure 1:
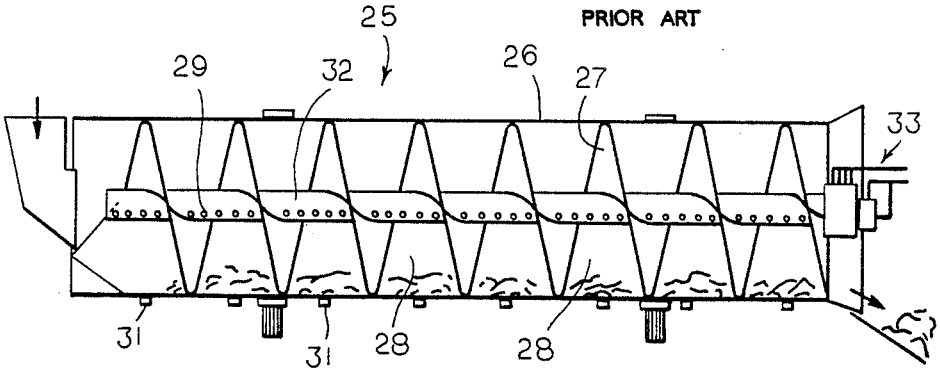
FIG. 1 is a cutaway view of a typical prior art washing machine.

Referring now in more detail to the drawings, in which like numerals indicate like parts throughout the several views, FIG. 1 illustrates a typical prior art tunnel batch washing machine 25. It comprises an outer cylindrical chamber 26 which has rigidly mounted therein a transfer screw or auger or worm 27 which divides the interior of the chamber into a plurality of compartments 28, 28. The transfer screw has mounted along its longitudinal axis a wash water supply pipe 32 having perforations 29 formed along its length within each of the compartments 28 formed by the transfer screw 27. The introduction of wash water into the compartments is controlled by a control valve system 33 and wash water is drained from each compartment after a wash cycle through drain valves 31.

Figure 2:
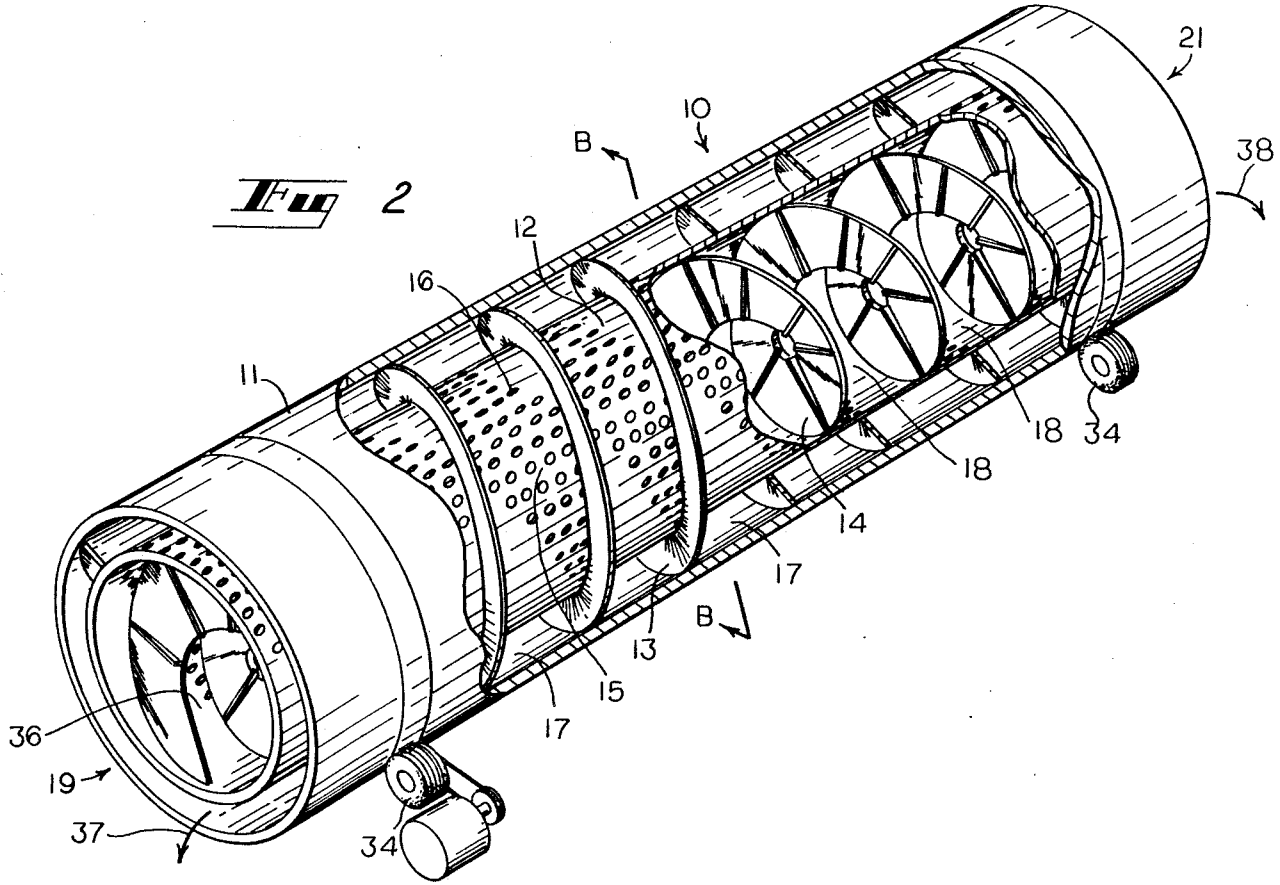
FIG. 2 is a perspective view of the invention with cutaway sections showing the inner and outer transfer helices.

FIG. 2 is a cutaway perspective view of the present invention showing the double drum batch washing machine generally indicated by the numeral 10. The washing machine 10 has an outer generally cylindrical chamber 11 for containing wash water or other treating media. Outer chamber 11 is mounted for rotation about its longitudinal axis on roller means 34. Drive means is connected to the washer for oscillating it through a predetermined angular range to affect washing and rotating it through a complete circle to affect transfer of laundry and wash water, as will be explained hereinafter. Mounted inside the outer chamber and spaced therefrom is a generally cylindrical inner chamber 12 for containing laundry or linen to be washed or otherwise treated. In the space between the inner and outer chambers is rigidly mounted an outer transfer screw or auger or worm 13 which has a pitch from left to right in the embodiment shown in FIG. 2. Outer transfer screw 13 divides the space between the chambers into a plurality of compartments 17, 17 for containing wash water during washing. Rigidly mounted around its periphery to the inside of inner chamber 12 is an inner transfer screw or auger or worm 14. Inner transfer screw 14 has a pitch that is generally the same in degree as that of outer transfer screw 13 but in the opposite direction, running from right to left in the embodiment shown in FIG. 2. Inner transfer screw 14 divides the space defined by the inner chamber into a plurality of compartments 18 for containing laundry during washing.

As can be seen in FIG. 2, the opposite pitches of screws 13 and 14 define areas of overlap 15 on the surface of inner chamber 12. Within the areas of overlap 15 on inner chamber 12 are formed a plurality of perforations or holes 16, 16 through which wash water may flow. It can be seen from FIG. 2 that wash water contained in one of the outer compartments 17 can communicate only with the corresponding overlapping inner compartment 18 because of the placement of the performations 16 only within the areas of overlap 15. Thus it is seen that wash water from one pair of corresponding overlapping inner and outer compartments cannot mix with wash water from adjacent pairs of compartments.

The invention as illustrated in FIG. 2 has an inlet end generally indicated by the numeral 19 and a discharge end generally indicated by the numeral 21. In the embodiment illustrated, laundry to be washed or treated is placed in first inner compartment 36 on inlet end 19 and wash water or other treatment media is introduced into first outer compartment 39 on discharge end 21. As washing machine 10 is rotated in a counterclockwise direction as viewed from inlet end 19, it can be seen from FIG. 2 that the laundry will be transferred by inner transfer screw 14 from inlet end 19 to discharge end 21 and wash water will be transferred by the outer transfer screw 13 from discharge end 21 to inlet end 19. Although FIG. 2 illustrates a particular pitch and direction of the transfer screws and operation is discussed assuming transfer is accomplished by counterclockwise rotation, it will be understood that other degrees and directions of transfer screw pitches as well as other transfer rotation directions will work equally well.

Figure 3:
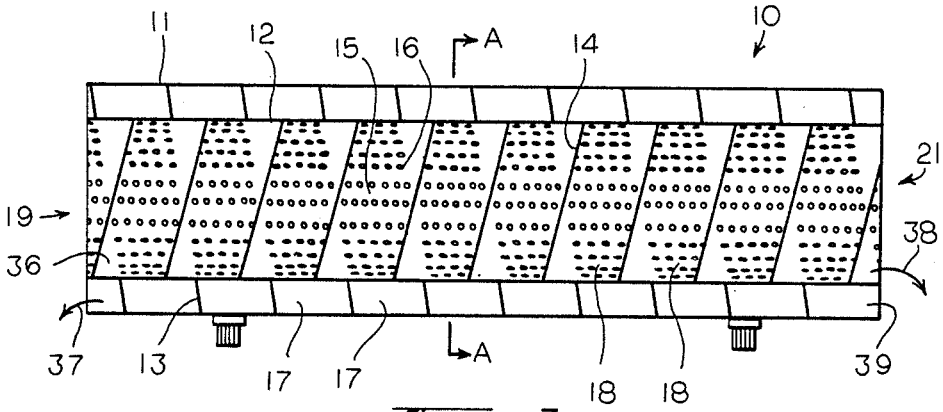
FIG. 3 is a side elevation cutaway view of the invention showing the inner and outer compartments and the perforations in the inner chamber.

FIG. 3 is a cutaway view of the invention taken along line BB in FIG. 2. This view shows the washing machine 10 and more clearly illustrates the definition of the areas of overlap 15 on the inner chamber 12. Perforations 16 are shown formed in the areas of overlap 15 defined by outer compartments 17 and inner compartments 18. As can be seen in FIG. 3, perforations 16, 16 are confined to the overlapping areas on chamber 12.

FIGS. 4*a* through 4*d* are a series of end elevation cutaway views of the invention taken generally along line AA in FIG. 3 illustrating the operation of a preferred embodiment of the invention. These figures show the locations of the wash water and the laundry at 4 stages of the cycle of washing machine 10. Illustrated in the figures is washing machine 10 having a generally cylindrical outer chamber 11. Inner chamber 12 is shown mounted in and spaced from outer chamber 11 and one wall of inner transfer screw 14 and outer transfer screw 13 are shown. The particular embodiment illustrated in this series of figures shows a generally concave floor member 22 which is impervious to the wash water and that extends along the length of washing machine 10. Floor member 22 is rigidly attached along its edges 41 to the inside of outer chamber 11 such that the line of attachment is impervious to the wash water. Floor member 22 closely approaches the bottom of inner chamber 12 generally near the middle of floor member 22. A dry well 24 is defined between the convex side of the floor member and the inside wall of the outer chamber 11. Dry well 24 may be used as a space in which to house electrical connections or plumbing and may be provided with access doors or ports through the outside chamber without affecting the operation of the washing machine. FIGS. 4*a* through 4*d* show cross sections of generic electrical or plumbing conduit 42.

Figure 4D:
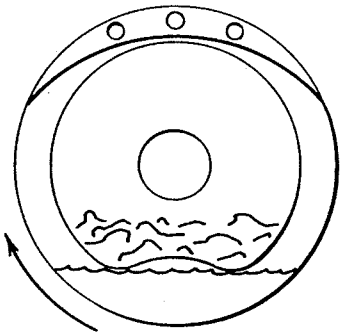
FIGS. 4*a* through 4*d* are cutaway end elevations along line AA of FIG. 3 showing one embodiment of the invention in various stages of the wash and transfer cycles of the machine.
Figure 4C:
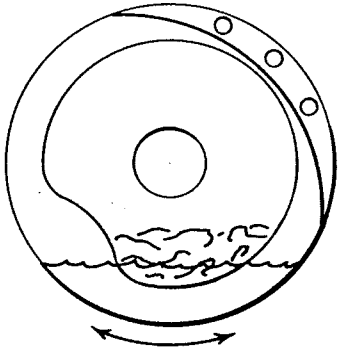
Figure 4B:
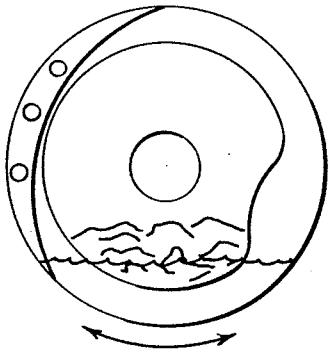
Figure 4A:
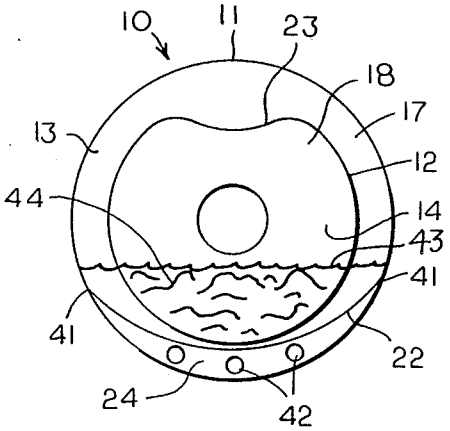

Also shown in the embodiment of the invention illustrated in FIGS. 4*a* through 4*d* is an inwardly convex ceiling member or bulge 23 formed in the top of inner chamber 12. FIG. 4*a* shows washing machine 10 in its normal or rest or reference position, and laundry 44 and wash water 43 are shown generally as they would be with washing machine 10 in this position. FIGS. 4*b* and 4*c* show the locations of the laundry and wash water near the two extreme extents of an oscillation range. FIG. 4*d* shows the location of the laundry and wash water near the midpoint of a transfer rotation of washing machine 10.

OPERATION

In operation, washing machine 10 is first loaded or filled with wash water or other treating media by supplying wash water into the first compartment 39 in the space between the outer and inner chambers 12 and 11, respectively. Washing machine 10 is rotated through a complete circle in the counterclockwise direction until it is in the rest or normal position as illustrated in FIG. 4*a*. Sufficient wash water has been added to each compartment so that in the rest position, laundry 44 is adequately wetted by wash water 43 so that it may be properly washed. Washing machine 10 is then oscillated through a predetermined angular range for a number of cycles as shown generally in FIGS. 4*b* and 4*c*. As washing machine 10 is oscillated, laundry 44 is agitated in wash water 43. Conventional ribs may be provided in the inner compartments if desired to aid in the agitation of the laundry. In addition, in the preferred embodiment illustrated in FIGS. 4*a* through 4*d*, as washing machine 10 oscillates through the normal position of FIG. 4*a*, the wash water rests on floor member 22 where it is raised above the bottom of outer chamber 11 and flows through perforations 16 into inner compartment 18. As the oscillation continues to its extreme limits as illustrated in FIGS. 4*b* and 4*c*, wash water gradually rolls off of floor member 22 until it rests on the inside wall of outer chamber 11. It is thus apparent that as washing machine 10 oscillates from extreme to extreme, wash water will be forced alternately into and out of inner compartment 18 and consequently into and out of laundry 44 contained therein. In addition, the level of the wash water is raised and lowered. This raising and lowering of wash water level in addition to the agitation of the laundry as washing machine 10 oscillates produces improved washing action over prior art washing machines.

At the end of a predetermined number of oscillations, it is desired to transfer the laundry to the next compartment in the inner chamber for the next wash cycle. This is accomplished by rotating washing machine 10 through a complete circle in the counterclockwise direction so that it is again in the rest position illustrated in FIG. 4*a*. During this rotation, the laundry is transferred by inner transfer screw 14 to the next compartment toward end 21 and wash water is transferred by transfer screw 13 to the next compartment between inner chamber 12 and outer chamber 11 toward end 19. At approximately the midpoint of the transfer rotation, the laundry rides over the ceiling member 23 as shown in FIG. 4*d*. This causes the laundry to be raised somewhat with respect to the wash water level so that excess wash water is drained into the outer compartment before the laundry is transferred to the next inner compartment. The wash and transfer process is repeated until the laundry has traversed the length of washing machine 10 and emerges from end 21 where it will typically be removed and transported to dryers or other treatment stations.

Several functions of the invention become apparent from the detailed description and operation set out above. The first function is the raising and lowering of the wash water level in the inner compartments during the wash cycle oscillations by virtue of floor member 22. This wash water action results in improved washing action. Another function is the raising of the laundry with respect to the wash water during a transfer rotation so that excess wash water is drained from the laundry before it is transferred to the next wash compartment. A function of the washing machine as described above is that during each transfer rotation, laundry is transferred one compartment in a first direction and wash water is transferred one compartment in the opposite direction. Thus the wash water is transferred, not to the next laundry compartment, but to the next one thereafter. In other words, a particular batch of water contacts the laundry in alternate, not adjacent, laundry compartments. The laundry, therefore, comes into contact with and is washed by only every other reservoir of wash water. This allows washing of different colors of fabric at the same time by alternating colors in the inner compartments. The inner compartments might, for example, be loaded alternately with red laundry, white laundry, red laundry, etc. and the wash water that comes into contact with the red laundry will never mix with the wash water that comes into contact with the white laundry, nor will it ever contact the white laundry.

The present invention is also very efficient in terms of the amount of wash water required during operation. Prior art continuous flow machines require a continuous supply of wash water flowing into the laundry discharge end of the machine. Prior art multiple drum machines and tunnel type machines with impervious transfer screw walls require that the volume of wash water in each compartment be partially or completely drained and fresh wash water resupplied upon completion of each wash cycle. Each of these prior art designs requires large volumes of wash water for each wash cycle.

During operation of the present invention, the volume of wash water contained in one outer compartment plus a smaller amount that remains in the wet laundry is transferred out of the machine upon each transfer rotation. To maintain the machine fully loaded with wash water, one need only add that same volume of fresh water to the first outer compartment at the other end of the machine at the end of each transfer rotation. Detergent or other treating chemicals can be added to the water before it is placed in the machine or it can be added in a conventional manner, e.g., through a central hub. As the laundry progresses down the length of the machine, it comes into contact with fresher and fresher water, so that at the discharge end, it is rinsed by fresh water in the last compartment. Because of this unique arrangement, it is possible to perform wash and rinse cycles without having to empty the water out.

Although the invention has been described in the form of a preferred embodiment, many modifications, additions and deletions may be made thereto without departure from the spirit and scope of the invention as set forth in the claims.

I claim:

1. A drum washing machine comprising:

an outer cylindrical chamber member having a longitudinal axis;

an inner cylindrical chamber member within said outer chamber member and spaced therefrom;

means for maintaining said inner and outer chamber members in spaced relationship, said means comprising a first longitudinally extending helix having a first pitch and being positioned between said inner and outer chamber members;

a second longitudinally extending helix having a second pitch and being mounted within said inner cylindrical chamber member;

said second pitch being opposite in direction from said first pitch with said first helix dividing the space between said first and second chamber members into a plurality of outer compartments for containing wash water and said second helix dividing the space defined by said inner chamber into a plurality of inner compartments for containing laundry, said inner and outer compartments defining areas of overlap on said inner cylindrical chamber member and said inner cylindrical chamber member having perforations formed within the areas of overlap so that fluid interchange is established between each inner compartment and the corresponding overlapping outer compartment;

said first and second helices being rigidly connected to said first and second cylindrical chamber members with said first cylindrical chamber member being mounted for rotation about its longitudinal axis; and means for oscillating the washing machine through a predetermined angular range to affect washing and rotating the washing machine through a complete circle to convey laundry to the next compartment in the space defined by the inner cylindrical chamber member in one direction of travel and wash water to the next compartment in the space between said inner and outer cylindrical chamber members in a direction of travel opposite the direction of travel of the laundry.

2. A drum washing machine comprising:

an outer cylindrical chamber member having a longitudinal axis;

an inner cylindrical chamber member within said outer chamber member and spaced therefrom;

means for maintaining said inner and outer chamber members in spaced relationship, said means comprising a first conveyor member extending between said inner and outer chambers;

a second conveyor member mounted within said inner cylindrical chamber member;

said first conveyor member being adapted to convey wash water in a direction of travel from one end of said outer cylindrical member to the other end thereof;

said second conveyor member being adapted to convey laundry from one end of said inner cylindrical chamber member to the other end thereof in a direction of travel opposite to the direction of travel of the wash water;

the walls of said inner chamber member being adapted to permit entry of the wash water into the space defined by said inner chamber; and means for raising and lowering the level of the wash water as the laundry is washed so that wash water moves into said outer of the laundry.

3. A drum washing machine comprising:

an outer cylindrical chamber member having a longitudinal axis;

an inner cylindrical chamber within said outer chamber members and spaced therefrom;

means for maintaining said inner and outer chamber members in spaced relationship, said means comprising a first conveyor member extending between said inner and outer chamber members;

a second conveyor member mounted within said inner cylindrical chamber member;

said first conveyor member being adapted to convey wash water in a direction of travel from one end of said outer cylindrical member to the other end thereof;

said second conveyor member being adapted to convey laundry from one end of said inner cylindrical chamber member to the other end thereof in a direction of travel opposite to the direction of travel of the wash water;

the walls of said inner chamber member being adapted to permit entry of the wash water into the space defined by said inner chamber; and means for raising the laundry with respect to the wash water so that excess wash water may be drained form the laundry.

4. A drum washing machine comprising:

a generally cylindrical outer chamber mounted for rotation about its longitudinal axis;

a generally cylindrical inner chamber member within said outer chamber member and spaced therefrom;

a first longitudinally extending helix having a first pitch, said first helix being rigidly mounted in the space between said inner and outer chamber members and dividing the space into a plurality of outer compartments for containing wash water;

a second longitudinally extending helix having a second pitch, said second pitch being the same as and opposite in direction from the pitch of said first helix, said second helix being rigidly mounted in the space defined by said inner chamber member and dividing the space into a plurality of inner compartments for containing laundry, said outer and inner compartments defining areas of overlap on said inner chamber member;

said inner chamber member having perforations formed in and confined to the areas of overlap defined by said inner and outer compartments so that wash water contained in one of the outer compartments can enter only the corresponding overlapping inner compartment during washing;

means for oscillating the washing machine through a predetermined angular range to affect washing;

means for rotating the washing machine through a full circle to affect transfer of laundry in one direction by said inner helix and transfer of wash water in the opposite direction by said second helix;

means for raising and lowering the level of the wash water as the washing machine oscillates; and means for raising the laundry with respect to the wash water as the washing machine rotates.

5. A double drum batch washing machine as claimed in claim 4 wherein said means for raising and lowering the level of the wash water as the washing machine oscillates comprises a longitudinally extending floor member rigidly attached along its edges to the inside of said outer chamber member and extending across the space between said outer and inner chambers, said floor member being located generally in the area of the midpoint of the oscillation range of the washing machine.

6. A double drum batch washing machine as claimed in claim 4 wherein said means for raising the laundry with respect to the wash water as the washing machine rotates comprises a longitudinally extending ceiling member attached along its edges to the inside of said inner chamber, said ceiling member being located generally in the area of the midpoint of the rotation of the washing machine so that as the washing machine rotates, the laundry becomes supported on said ceiling in a raised position with respect to the wash water.

7. A drum washing machine comprising:

an outer cylindrical chamber member having a longitudinal axis;

an inner cylindrical chamber member within said outer chamber member and spaced therefrom;

means for maintaining said inner and outer chamber members in spaced relationship, said means comprising a first conveyor member extending between said inner and outer chamber members;

a second conveyor member mounted within said inner cylindrical chamber member;

said first conveyor member comprising a first longitudinally extending helix having a first pitch;

said second conveyor member comprising a second longitudinally extending helix having a second pitch with said second pitch being opposite in direction from said first pitch;

said first helix dividing the space said inner and outer chamber members into a plurality of outer compartments for containing wash water and said second helix dividing the space defined by said inner cylindrical chamber member into a plurality of inner compartments for containing laundry, said inner and outer compartments defining areas of overlap on said inner cylindrical chamber member; and said inner cylindrical chamber member having perforations formed within the areas of overlap so that fluid interchange is established between each inner compartment and the corresponding overlapping outer compartment.

8. A drum washing machine as claimed in claim 7 wherein said inner and outer helices are rigidly connected to said first and second cylindrical chamber members and said outer cylindrical chamber member is mounted for rotation about its longitudinal axis.

9. A drum washing machine as claimed in claim 8 further comprising means for raising and lowering the level of the wash water as the laundry is washed so that wash water moves into and out of the laundry.

10. A drum washing machine as claimed in claim 8 further comprising means for raising the laundry relative to the wash water so that excess wash water may be drained from the laundry.

* * * * *